United States Patent [19]

Harding

[11] Patent Number: 4,577,351

[45] Date of Patent: Mar. 25, 1986

[54] PORTABLE TOILET CABANA

[75] Inventor: George W. Harding, Clearwater, Fla.

[73] Assignee: Poly-John Enterprises Corp., Whiting, Ind.

[21] Appl. No.: 666,560

[22] Filed: Oct. 30, 1984

[51] Int. Cl.[4] ..... A47K 11/02

[52] U.S. Cl. ..... 4/460; 52/282

[58] Field of Search ..... 4/460, 462, 463, 449, 4/614; 52/282, 285, 288, 275; 220/4 F, 80

[56] References Cited

U.S. PATENT DOCUMENTS

| | | | |
|---|---|---|---|
| 867,239 | 10/1907 | Bowers | 220/80 |
| 984,267 | 2/1911 | Ferres | 52/282 |
| 2,156,347 | 5/1939 | McLaughlin, Jr. | 52/282 |
| 2,751,109 | 6/1956 | Moore | 220/80 |
| 2,809,404 | 10/1957 | Hinds | 52/282 |
| 2,912,013 | 10/1959 | Freyholdt et al. | 52/282 |
| 3,226,008 | 12/1965 | Chiorri | 220/80 |
| 3,323,819 | 6/1967 | Barker | 52/285 |
| 3,447,167 | 6/1969 | Harding | 4/462 |
| 3,835,480 | 9/1974 | Harding | 4/462 |
| 3,938,199 | 2/1976 | Laven | 52/282 |
| 4,065,885 | 1/1978 | Blick, III et al. | 52/282 |
| 4,446,585 | 5/1984 | Harding et al. | 4/460 |

FOREIGN PATENT DOCUMENTS

| | | | |
|---|---|---|---|
| 302887 | 3/1972 | U.S.S.R. | 220/4 F |

*Primary Examiner*—Stephen Marcus
*Assistant Examiner*—Leo J. Peters
*Attorney, Agent, or Firm*—Cullen, Sloman, Cantor, Grauer, Scott and Rutherford

[57] ABSTRACT

A portable toilet cabana is formed of four relatively resilient, sheet plastic walls joined together along their vertical edges by an impact protective and structural stiffening corner joint. The adjacent vertical edges are formed with parallel, narrow flanges bent about 45° out of the planes of their sheets and an extruded T-shaped connector is arranged with its stem between the flanges and its head overlapping the free edges of the flanges. Mechanical fasteners extend through, and laminate together, the pairs of aligned flanges and the connector stem. Narrow, vertical, bumper forming channels are integrally formed in each of the sheets adjacent their corner flanges and extend outwardly of the walls a sufficient distance to protect the corners against impacts to the sides of the cabana and yet, are close enough together so that the pair of adjacent bumpers can be grasped in one hand for moving the cabana. A roof panel covering the wall forming enclosure has step-like edge portions overlapping and fastened to the upper edges of the walls, and terminating in a depending horizontally extended, angularly arranged edge flange. The edge portions stiffen and reinforce the cabana structure in cooperation with the corner construction.

3 Claims, 5 Drawing Figures

Fig-1
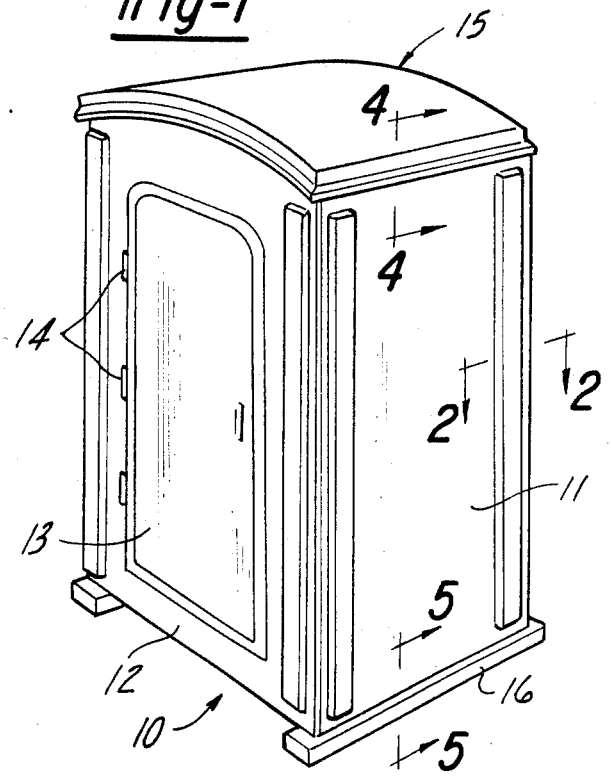
Fig-2
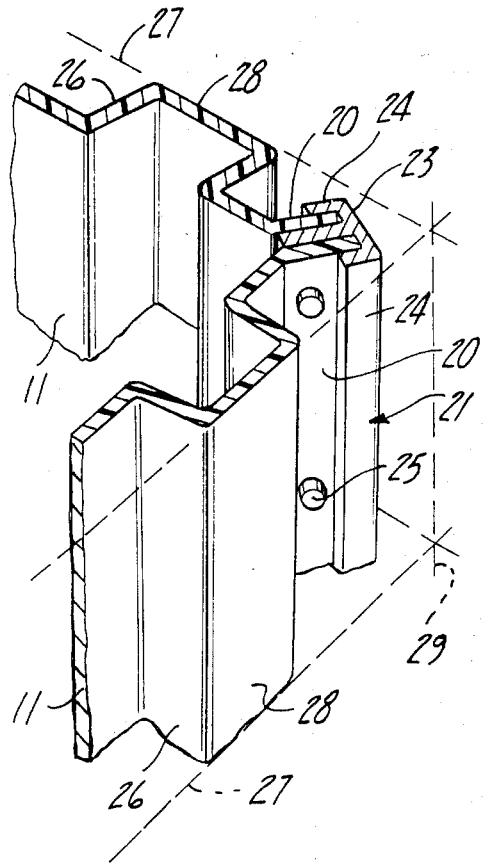
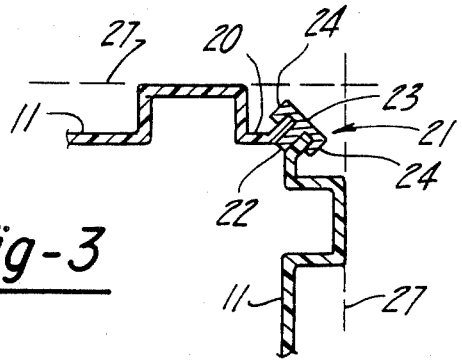
Fig-3
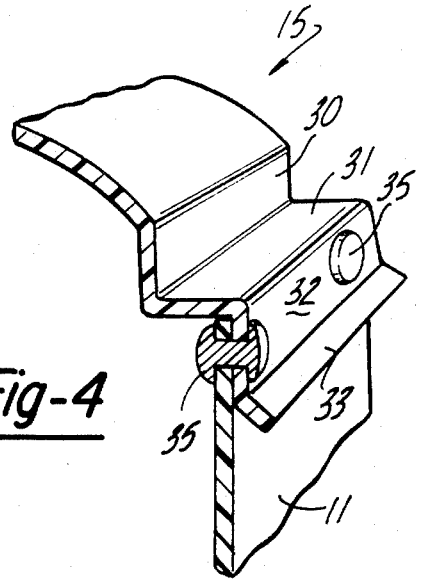
Fig-4
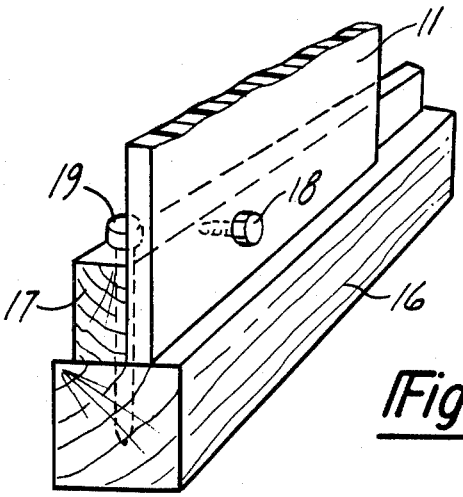
Fig-5

PORTABLE TOILET CABANA

BACKGROUND OF INVENTION

This invention relates to improvements in cabanas or sheds used for portable toilets and other relatively small, portable or easily movable storage shed-like structures which are made of sheets of plastic that are joined together.

These structures are relatively lightweight and may be moved from time to time, particularly where they are used for temporary toilet purposes. Thus, they are relatively easily damaged. Particularly, their corners and corner areas are frequently damaged due to impacts resulting from moving the structures or transporting them upon delivery trucks. In addition, since they are bulky and are formed of large sheets of relatively slippery plastic material, these structures are difficult to manually grasp, for moving purposes, in a way that avoids dropping and damaging the structures. Also, rigidifying or reinforcing the structure of plastic sheet cabanas of the type involved, has been relatively difficult and expensive.

Consequently, the invention herein relates to providing improved corner joints for connecting the plastic sheet walls together in a manner that protects the corners and rigidifies the structure, and also provides means for manually grasping the structure. Further rigidification is provided by flange formations on the edges of the roof panel.

SUMMARY OF THE INVENTION

The invention herein contemplates forming a cabana corner joint which rigidifies or stiffens the structure and is self-protecting against impact damage. The joint is formed by bending adjacent vertical wall panel edges at about 45° to the planes of the walls so that a pair of spaced apart flanges are provided. A T-shaped metal or plastic extrusion has its stem positioned between the flanges and its head overlapping the raw or free edges of the flanges. The flanges and stem are mechanically secured together to form a three-ply reinforced, rigidifying, corner support beam. The support beam-like corner is protected by vertically formed channels which provide, first, bumpers to protect the corners; second, reinforcing strips; and third, a hand grip means. Thus, the corner structure simultaneously forms the necessary panel edge connections and stiffens the cabana structure, while being self-protecting against impact damage.

The invention further contemplates forming the outer edges of the plastic cover panel of the enclosure structure with an integral reinforcing edge flange formation that cooperates with the corner reinforcing structure for further rigidifying the cabana.

One object of this invention is to provide a corner construction, that interconnects the four panels which make up a cabana, that permits the panels to be shipped and handled in knock-down condition and easily assembled together to form the complete cabana structure. Further, upon assembly, that is, upon connection of the corners, the cabana is substantially rigidified while simultaneously the corners are protected against damage due to impact.

Moreover, it is an object to form such cabana corners in a manner so as to simultaneously connect, reinforce, protect the connection and provide a hand grip, all as part of the same construction.

Another object of this invention is to provide a relatively inexpensive, simple to form construction which provides a cabana of increased strength and damage resistance which can be handled in a knock-down condition.

These and other objects and advantages of this invention will become apparent upon reading the following description, of which the attached drawings form a part.

DESCRIPTION OF DRAWINGS

FIG. 1 is a perspective view of a cabana incorporating the invention herein.

FIG. 2 is an enlarged, perspective, fragmentary view of a corner of the cabana, taken in the direction of arrows 2—2 of FIG. 1.

FIG. 3 is a reduced scale, cross-sectional view of a corner taken as if in the direction of arrows 2—2 of FIG. 1.

FIG. 4 is an enlarged, fragmentary, perspective view of a portion of the roof and adjacent wall panel connection, taken in the directions of arrows 4—4 of FIG. 1.

FIG. 5 is an enlarged, perspective view of a part of the lower end of the cabana, taken in the direction of arrows 5—5 on FIG. 1, and illustrating the connection of the skid to the wall.

DETAILED DESCRIPTION

FIG. 1 illustrates a cabana or similar type structure 10 which is formed of similar side and rear walls 11 and a front wall 12 which are made out of plastic sheet-like material. Suitable commercially available plastics may be used, as for example, linear polyethylene which is relatively stiff, but has some inherent resiliency or springiness. The thickness of the walls may vary, depending upon the strength required and the type of material used. For example, the wall thickness can be in the area of about $\frac{1}{8}$ to $\frac{1}{4}$ inch thick. The walls are generally flat, that is, they are planar or slightly bowed or contoured.

An opening is provided in the front wall 12 and a door 13 is connected by hinges 14 to cover the opening. Thus, the cabana is a small house-like structure which is usable particularly for portable toilet purposes, but also for other purposes where a small size building or shed is needed, such as for storage purposes, bath house changing rooms or the like.

The cabana is provided with a curved roof panel 15 which is connected to the walls. The entire structure is mounted upon a pair of skids 16 for resting upon a ground surface, and which permit it to be easily moved and lifted upon a delivery truck or the like. The skids are secured to the lower edges of the side walls, as shown in FIG. 5, by means of a wood strip 17 such as a 2×4, which is fastened by bolts or screws 18 and 19 to the walls and skids respectively. Also is suitable adhesive may be impelled between the walls, wood strips and skids for better connections.

The means for connecting the walls together is illustrated in FIGS. 2 and 3. The adjacent vertical edges of the walls are bent into approximately 45° angle corner flanges 20. The adjacent flanges are parallel, but spaced apart from one another.

A T-shaped connector 21, which may be made of an extruded plastic or aluminum or other metal, has its stem portion 22 arranged between the adjacent flanges.

The connector head 23 overlies the free or raw edges of the flanges and the ends of the head are bent or formed into wrap-around strips or lips 24 to overlap the portions of the flanges adjacent the free edges.

Suitable mechanical fasteners, such as rivets 25, bolts or the like, extend through the adjacent, overlapped corner flanges and T-shaped connector stem to form a complete three-ply and a partial five-ply, vertical post-like rigid connection. Thus, the corner connections between the adjacent vertical edges of the walls also serve to rigidfy or stiffen the cabana structure as if separate posts were utilized.

The wall portions adjacent the corners are formed with integrally molded bumper or stiffening channels 26. As indicated by dotted lines 27 in FIG. 2, the bases 28 of these channels are outwardly of the planes of their respective panels and are also outwardly of the extreme outer edges of the head of the T-shaped connector. The channels form a phantom corner (see dotted line 29) where the dotted line 27 extensions intersect. Thus, the channels serve to protect the connector 21 and the corner joints from sidewise directed impacts resulting from the cabana being laid or dropped on its sides or struck by the walls of a vehicle upon which the cabana is carried, etc. As a result, a major reason for damage to the cabana is eliminated. Moreover, the integral channels 26 act like vertical reinforcing beams or posts which further stiffen and rigidify the complete structure, in conjunction with the corner three-ply and five-ply beam formed by the flanges and connector.

The curved roof panel or cover 15, as illustrated in FIG. 4, includes vertically downwardly extending edge portions which are shaped to engage over the upper edge of the walls, to which they are fastened. The panel edge portions are formed like steps, beginning with an upper, vertical riser-like strip 30, then a horizontal tread-like strip 31, a lower vertical riser-like strip 32 and finally an approximately 45° bent lower edge flange strip 33. Rivets 35 fasten the strips 32 to the upper edge portions of the walls 11. Preferably the panel edge portions, with their flange edge strips, extend continuously around the periphery of the roof panel. This serves to substantially rigidify or stiffen the panels and the roof in the horizontal direction. That is, the step-like edge portions act like horizontal beams connected between the vertical beam-like channels 26 and post-like corners of the wall panels. In addition, the flange strip turns water away from the sides of the cabana.

Having fully described an operative embodiment of this invention, I now claim:

1. A portable toilet-type cabana comprising:

vertically arranged, relatively resilient plastic sheet walls which are fastened together along their adjacent vertical edges;

the adjacent vertical edge portions of at least one pair of such walls being bent into parallel, spaced apart, vertically elongated flanges that are arranged at roughly 45° angles to their respective walls;

a substantially T-shaped in cross section, vertically elongated, corner connector strip arranged with the stem of the T-shape between and in face to face contact with the respective flanges substantially throughout the entire length of said flanges and mechanically secured together with said flanges;

the head of the T-shaped connector overlying and generally in face to face contact with the free ends of each of the flanges;

integral, vertically arranged, relatively narrow channels formed in the walls closely adjacent to, but spaced a short distance from the junctures of their edge flanges with the vertical walls, with the channels opening inwardly of the cabana so that their bases and side walls are spaced outwardly of the planes of their walls;

and the channels being sufficiently deep so that the bases of the channels are located in planes that are further outwardly of the planes of their walls, that is, relative to the interior of the cabana, than are the opposite ends of the head of the T-shaped corner connector, wherein the channels from relatively resilient, protective bumpers for the corner joint between the cabana walls, including the T-shaped corner connector, as well as form hand grips for manually grasping the cabana at its corner for moving the cabana;

and with the flanges and stem being mechanically fastened together by rivets extended through them to form a three layer, structural reinforcing strip at the cabana corner.

2. A portable cabana as defined in claim 1, and including all four corners of the cabana being formed in the same manner described above.

3. A portable cabana as defined in claim 2, and including a unitary, roof-forming cover arranged over the upper edges of the four walls and mechanically secured to the walls;

said cover including a panel overlying the opening of the enclosure formed by the walls and having a vertically downwardly bent edge portion which overlaps and is fastened to the upper edges of the walls along their outer faces, edge portion formed in a step-like shape having a tread-like strip overlapping the free edge of its respective wall, with a depending riser-like portion, secured by mechanical fasteners to the adjacent upper edge portion of its respective wall, and with its lower, free edge being bent outwardly and downwardly to form an integral, continuous, narrow flange strip for horizontally reinforcing and stiffening the upper free ends of the cabana walls in conjunction with the corner constructions vertically reinforcing and stiffening the walls.

* * * * *